US005462185A

United States Patent [19]

Walker, III

[11] Patent Number: 5,462,185

[45] Date of Patent: Oct. 31, 1995

[54] DISPENSING CLOSURE FOR FLUID CONTAINERS

[76] Inventor: Clifford M. Walker, III, 4505 Revillo Way, San Diego, Calif. 92115

[21] Appl. No.: 276,303

[22] Filed: Jul. 18, 1994

[51] Int. Cl.[6] ..... B65D 51/16; B65D 25/28

[52] U.S. Cl. ..... 215/307; 220/752; 220/367.1

[58] Field of Search ..... 220/212.5, 754, 220/752, 367, 254, 715; 215/307, 329, 100 R, 100 A; 222/481.5; 224/148

[56] References Cited

U.S. PATENT DOCUMENTS

| | | | |
|---|---|---|---|
| 2,020,343 | 11/1935 | Willing | 40/307 |
| 2,243,629 | 5/1941 | Hodgson | 40/307 |
| 3,020,659 | 2/1962 | Paulini | 40/307 |
| 3,207,359 | 9/1965 | Heisler et al. | 220/771 |
| 4,094,433 | 6/1978 | Numbers | 220/715 |
| 4,782,985 | 11/1988 | Kinsley | 222/481.5 |
| 4,898,292 | 2/1990 | Ver Weyst et al. | 220/254 |
| 5,042,698 | 8/1991 | Fessell | 222/481.5 |
| 5,203,481 | 4/1993 | Dobbins et al. | 215/100 A |
| 5,232,110 | 8/1993 | Purnell | 222/481.5 |
| 5,341,657 | 8/1994 | Fuller | 220/754 |

*Primary Examiner*—Allan N. Shoap
*Assistant Examiner*—Robin A. Hylton
*Attorney, Agent, or Firm*—Charles C. Logan, II

[57] ABSTRACT

A dispensing closure for fluid containers having an externally threaded neck. The dispensing closure has a tubular cap, a closure lid, and an elongated connecting strip between the tubular cap and the closure lid. A pair of finger gripping arms extend transversely from opposite sides of the tubular cap and each has a pair of radially spaced slots therein for detachably receiving the opposite ends of a carrying strap. An interior wall extends transversely within the bore hole of the tubular cap and it has an aperture that is aligned with and connected to the top end of a vent tube that extends a predetermined distance below the bottom edge of the tubular cap. The interior wall has a fluid passage aperture through which a person using the dispensing closure would drink. The closure lid is easily and quickly snapped on and off the top of the tubular cap. The tubular cap has internal threads adjacent its bottom end.

13 Claims, 1 Drawing Sheet

DISPENSING CLOSURE FOR FLUID CONTAINERS

BACKGROUND OF THE INVENTION

The invention relates to dispensing closures and more specifically to dispensing closures for commercially available fluid and beverage containers having an externally threaded neck.

Screw-on fluid closures are well known in the prior art. The majority of these closures are used for the purpose of sealing the fluid container during shipping and storage. Once the container reaches the consumer, the closure or cap is removed and often discarded. At times the closure is saved and used to reseal the container for storage of the remaining fluid. By resealing a carbonated beverage fluid container, the beverage tends to keep its carbonation. The remaining fluid tastes better than if left unsealed and allowed to go flat. By resealing the container, the user can transport or store the unused portion of fluid without worrying about contamination or spilling the fluid.

There are many aftermarket fluid or beverage closures that a consumer can purchase if they misplace the original closure. Some closures have enlarged gripping areas to allow the closure to be removed easily. There are dispensing closures that have a straw protruding through the center of the closure to allow the user to drink a beverage from a straw. Some dispensing closures have an elongated lid that fits over a spout that aids in the dispensing of the fluids. There are "pour spouts" that have a vent that allows air to replace the fluid and this aids in pouring the fluids. The disadvantage to the consumer of the later three devices is that they do not create an air tight seal. This provides questionable protection against leakage and or spilling of the fluid when being stored. The aftermarket snap-on and screw-on closures do not assist the user in the dispensing or consumption of the fluid. These devices only act as a replacement to the original closure in the event it is misplaced.

It is an object of the invention to provide a novel dispensing closure for fluid containers having an externally threaded neck that can create an air tight seal which is usable with carbonated and noncarbonated liquids.

It is also an object of the invention to provide a novel dispensing closure for fluid containers having an externally threaded neck that has a snap-on and snap-off closure lid that eliminates the need for unscrewing the closure device each time the user wants to take a drink.

It is another object of the invention to provide a novel dispensing closure for fluid containers having an externally threaded neck that can be used by children and adults not having the strength or dexterity to unscrew a normal screw-on closure device.

It is an additional object of the invention to provide a novel dispensing closure for fluid containers having an externally threaded neck that has a vent tube that prevents a vacuum from being formed in the container as the person is drinking or pouring its contents.

It is a further object of the invention to provide a novel dispensing closure for fluid containers having an externally threaded neck that has structure for detachably securing a carrying strap to the closure device.

SUMMARY OF THE INVENTION

The novel dispensing closure for fluid containers having an externally threaded neck has many advantages. One of these advantages is it provides an air-tight seal between the interior of the tubular cap and the top end of the threaded neck of a fluid container. The main body portion of the tubular cap has internal threads adjacent its bottom end, and it has an internally formed annular channel adjacent its top end. The annular channel has been configured to either receive an O-ring or to directly receive the top edge of the threaded neck of the fluid container.

The main body portion of the tubular cap has a transversely extending interior wall having an aperture therein that communicates with the bore hole in the top end of a vent tube. The vent tube extends downwardly a predetermined distance below the bottom edge of the main body portion. When the dispensing closure has been screwed on the externally threaded neck of a fluid container, the bottom end of the vent tube extends into the interior of the container a predetermined distance. When a person is drinking from the container, air from the person's mouth can travel into the container to replace the liquid that is being removed. This prevents a vacuum from being formed in the container that in some instances tends to collapse the container. Also it prevents the interrupted flow or gurgling often present while drinking from a container. When this type of action occurs, the flow of liquid into the person's mouth then comes in surges and results in some of the liquid being spilled on the person drinking. The transversely extending interior wall also has a half moon shaped fluid passageway aperture. It is through this opening that the person drinks or pours fluid from the container.

The main body portion of the tubular cap also has a pair of transversely extending finger gripping arms. These finger gripping arms allow the tubular cap of the closure to be quickly and easily screwed on and off the top end of an externally threaded container. The finger gripping arms each have a front wall that tapers rearwardly and this allows the person drinking from the dispensing closure to place their lower lip against the main body portion of the tubular cap. The top edges of the finger gripping arms also slope downwardly and away from the main body portion which also functions to aid in allowing the person to place their mouth on the top of the dispensing closure while drinking therefrom. Each finger gripping arm has a pair of radially spaced slots for removably receiving the ends of a carrying strap. There are gripping teeth in at least one of these slots. Each end of the carrying strap is preferably secured to the finger gripping arms by first taking the end of the strap downwardly past the end wall of the finger gripping arms and then reversing it upon itself. Next, it is threaded upwardly through the outermost slot. Then it is reversed upon itself once more, and it is threaded downwardly through the innermost slot. The downwardly and outwardly sloping top surface. of the finger-gripping arms allows the thickness of the strap to be snug against the finger-gripping arm in such a manner that it doesn't conflict with the person placing his/her mouth over the neck portion of the tubular cap. By having the strap traveling downwardly past the end wall of the finger gripping arms, that portion of the strap is also kept a maximum distance away from the person's mouth and keeps it from interfering while drinking.

In its preferred form, the tubular cap, closure lid, and connecting strip would be made of a single flexible, resilient, plastic or polymer molded part. The connecting member prevents the misplacement or loss of the closure lid when the dispensing closure unit is in its open position.

The closure lid in its closed position is snapped onto the top of the neck of the tubular cap. The closure lid has two inwardly sloping annular flanges. The bottom annular flange is the closure female connecting lip, and it provides an air-tight seal between the tubular cap and the closure lid when it is snapped over the neck portion of the tubular cap. The upper annular flange of the closure lid is undercut, and it has a dual purpose. This undercut allows for an optional separate disc having promotional material or advertising copy on it to be popped into this area and to be held securely in place by the undercut. Secondly this undercut is used in the molding process to hold the closure lid against the same plate as the inner thread core. This allows a stripper plate to extract the tubular cap, the connecting strip and the closure from the plate without a need for an A side ejector. This process permits the mold to run at much greater speeds, thus reducing manufacturing costs considerably, in addition to reducing mold costs. The center of the closure lid has an inward sloping arch that allows the lid to use the pressure from within the container to further increase the lid's ability to hold an air-tight seal on the tubular cap.

The closure is easily opened and closed using the snap-on lid as opposed to constantly having to screw and unscrew a closure lid, which can be difficult for children, the disabled, elderly people and women with long fingernails.

The connecting strip also prevents the misplacement of the closure lid by children, or absent-minded person. It also aids elderly and handicapped persons, who have shaking hands, snap the lid back on without dropping the lid and possibly contaminating or losing the lid. This snap-on lid also aids people who are in the act of performing athletic activities in their opening and closing the beverage container with ease while running, biking, hiking, mountain climbing, etc. The dispensing closure is reusable and may be sold with a container or as an aftermarket item sold in stores.

DESCRIPTION OF THE PREFERRED EMBODIMENT

Figure 1:
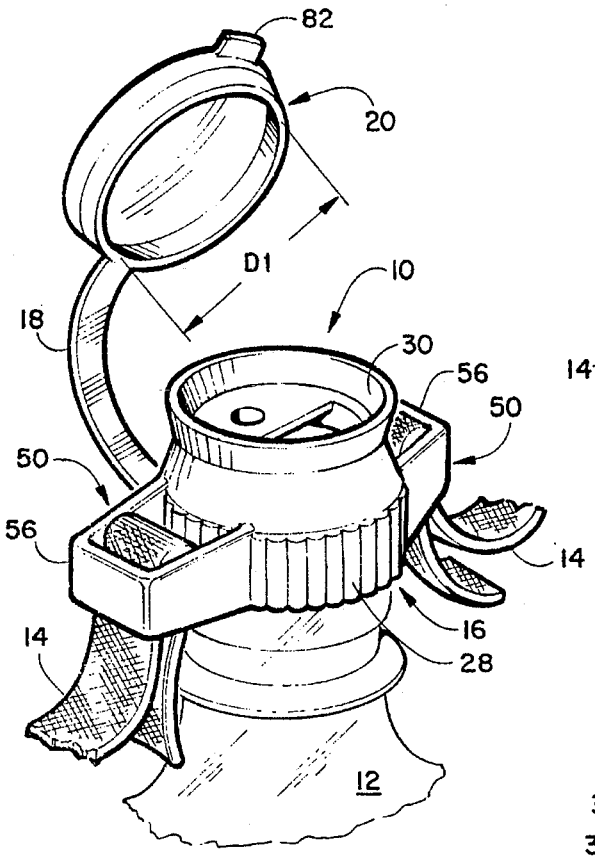
FIG. 1 is a front perspective view of the novel dispensing closure for fluid containers having an externally threaded neck.
Figure 2:
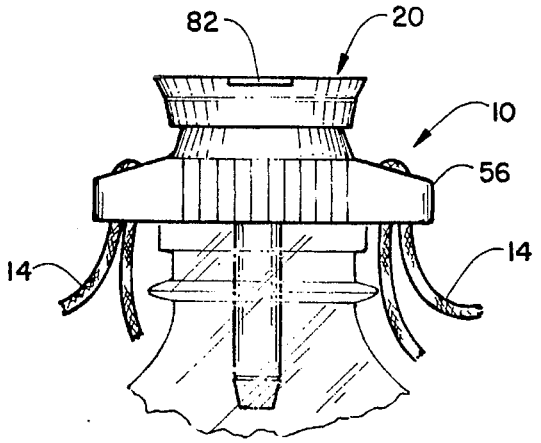
FIG. 2 is a front elevation of the dispensing closure with the closure lid secured to the top of the tubular cap.
Figure 3:
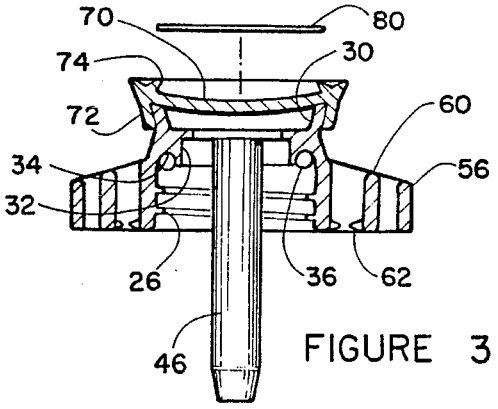
FIG. 3 is a cross sectional view of the closure lid on the tubular cap.
Figure 5:
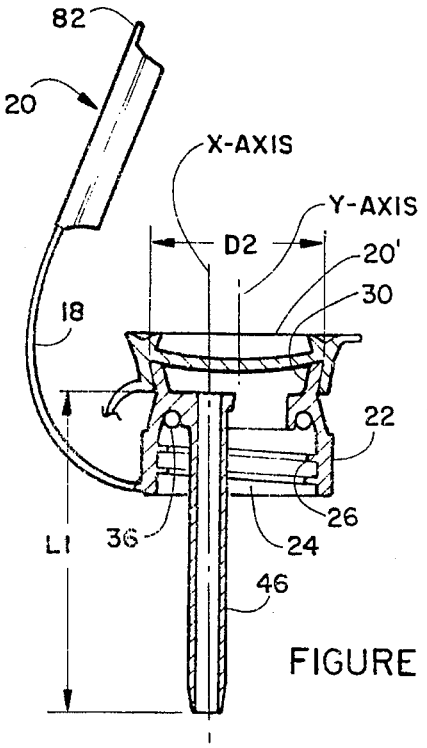
FIG. 5 is a cross sectional view taken along lines 5—5 of FIG. 4.
Figure 4:
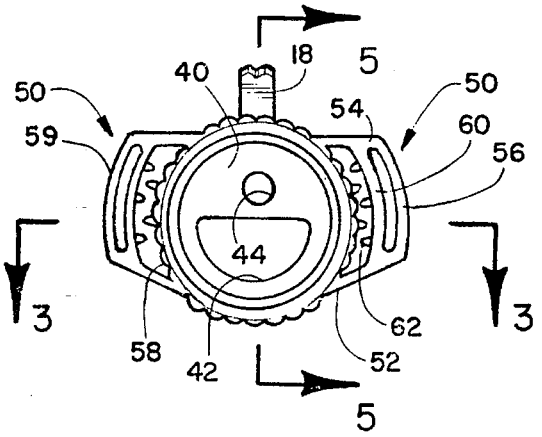
FIG. 4 is a top plan view of the tubular cap.

The novel dispensing closure for fluid containers having an externally threaded neck will now be described by referring to FIGS. 1–5 of the drawing. The dispensing closure is generally designated numeral 10. In FIG. 1, it is threaded on the neck of a bottle 12. A carrying strap 14 has its opposite ends secured to the tubular cap 16.

Dispensing closure 10 has a tubular cap 16, an elongated strip 18 and a closure lid 20. In their preferred form, they are integrally formed from a plastic material. Tubular cap 16 has a main body portion 22 having a bore hole 24 extending from its top end to its bottom end. Internal threads 26 are formed adjacent the bottom end of main body portion 22. Gnarled gripping ribs 28 are formed on the exterior surface of main body portion 22 adjacent its bottom end. Neck 30 has a downwardly and inwardly extending annular flange or lip 32 that forms an annular channel 34 on its underside. An 0-ring 36 is positioned within annular channel 34 for sealing the tubular cap on the threaded neck of a container. An intermediate wall 40 extends transversely to the longitudinal Y-axis of main body portion 22. A half-moon shaped fluid passage aperture 42 is formed in intermediate wall 40. It also has an air passageway aperture 44 aligned with and connected to the top end of a vent tube 46 having a longitudinally extending X-axis. Vent tube 46 has a predetermined length L1 in the range of 1–4 inches. A pair of finger gripping arms 50 extend transversely from opposite sides of main body portion 22. Each finger gripping arm 50 has a front wall 52, a rear wall 54, and an end wall 56. A pair of radially spaced slots or apertures 58 and 59 are separated by an intermediate wall 60. Slots 58 have a plurality of gripping teeth 62.

Closure lid 20 has a circular disc portion 70 having an annular lip 72 extending downwardly from its outer edges. An annular flange 74 extends upwardly from circular disc portion 70. The bottom edge of annular lip 72 has an inner diameter D1 that is slightly smaller than the outside diameter D2 of the upper edge of neck portion 30 of main body portion 22. These two mating structures have enough flexibility to enable the closure lid to be snapped on and off of the top end of tubular cap 16. Top annular flange 74 has an undercut edge for receivably gripping a circular advertising copy disc 80 that can be detachably secured to the top of closure lid 20. Circular disc portion 70 has a concave top surface that aids it in resisting pressure within a pressurized beverage bottle. A tab 82 extends from the front end of closure lid 20.

What is claimed is:

1. A dispensing closure for a container having an externally threaded neck comprising:

a tubular cap having a top end, a bottom end, a longitudinal axis, a front side, a rear side, a left side and a right side, said tubular cap having a main body portion with a neck formed adjacent its top end; said tubular cap having a longitudinally extending bore hole that defines an inner wall surface, and said inner wall surface having internal threads formed adjacent said bottom end;

means on the interior of said bore hole for sealing the top end of the neck of a bottle once the tubular cap is threaded to the bottle;

a pair of finger-gripping arms extending transversely from diameterically opposite sides of said tubular cap; each of said finger-gripping arms having means for securing the opposite ends of a carrying strap comprising structure for interlocking said carrying strap to said finger-gripping arms; and a closure lid for said tubular cap, and said lid having a top surface that covers said cap at the top end thereof.

2. A dispensing closure for a container having an externally threaded neck as recited in claim 1 further comprising an elongated member having a first end, a second end and a predetermined length, said first end being connected to said tubular cap and said second end being connected to said closure lid to form a tethered lid.

3. A dispensing closure for a container having an externally threaded neck as recited in claim 2 wherein said tubular cap, said elongated member and said closure lid are formed as an integral unit.

4. A dispensing closure for a container having an externally threaded neck as recited in claim 1 wherein said means on said finger-gripping arms for securing the opposite ends of a carrying strap comprises at least one slot in each of said finger-gripping arms and said slots each have a peripheral edge.

5. A dispensing closure for a container having an externally threaded neck as recited in claim 1 further comprising a disc for advertising copy and means on the top surface of said closure lid for detachably securing said disc to said closure lid.

6. A dispensing closure for a container having an externally threaded neck as recited in claim 1 further comprising an elongated vent tube having a top end, a bottom end and a predetermined length L1, and means for securing said top end of said vent tube to the inner wall surface of the bore hole in said main body portion.

7. A dispensing closure for a container having an externally threaded neck as recited in claim 6 wherein said means in the interior of said bore hole for sealing the top end of a bottle comprises an inwardly and downwardly extending annular flange adjacent to the top end of the neck of said tubular cap and forming an annular channel with said inner wall surface.

8. A dispensing closure for a container having an externally threaded neck as recited in claim 7 further comprising an O-ring positioned in said annular channel for sealing said tubular cap on the threaded neck of a container.

9. A dispensing closure for a container having an externally threaded neck as recited in claim 6 wherein said means for securing the top end of said vent tube to the inner wall surface of said main body portion comprises an interior wall extending transversely within the bore hole of said tubular cap, said interior wall having an aperture that is aligned with and connected to the top end of said vent tube.

10. A dispensing closure for a container having an externally threaded neck as recited in claim 9 wherein said interior wall has a fluid passage aperture for dispensing fluid from the container.

11. A dispensing closure for a container having an externally threaded neck as recited in claim 10 wherein said fluid passage aperture is half-moon shaped.

12. A dispensing closure for a container having an externally threaded neck comprising:

a tubular cap having a top end, a bottom end, a longitudinal axis, a front side, a rear side, a left side and a right side, said tubular cap having a main body portion with a neck formed adjacent its top end; said tubular cap having a longitudinally extending bore hole that defines an inner wall surface, and said inner wall surface having internal threads formed adjacent said bottom end;

means on the interior of said bore hole for sealing the top end of the neck of a bottle once the tubular cap is threaded to the bottle;

a pair of finger-gripping arms extending transversely from diameterically opposite sides of said tubular cap; each of said finger-gripping arms having means for securing the opposite ends of a carrying strap comprising at least one aperture in each of said finger gripping arms and said apertures each have a first peripheral edge extending substantially along a portion of the perimeter of said bottom of said cap, a second peripheral edge opposing each first peripheral edge, an aperture on each arm having gripping teeth extending from said first and second edges.

13. A dispensing closure for a container having an externally threaded neck comprising:

a tubular cap having a top end, a bottom end, a longitudinal axis, a front side, a rear side, a left side and a right side, said tubular cap having a main body portion with a neck formed adjacent its top end; said tubular cap having a longitudinally extending bore hole that defines an inner wall surface, and said inner wall surface having internal threads formed adjacent said bottom end;

means on the interior of said bore holes for sealing the top end of the neck of a bottle once the tubular cap is threaded to the bottle;

a pair of finger-gripping arms extending transversely from diameterically opposite sides of said tubular cap; each of said finger-gripping arms having means for securing the opposite ends of a carrying strap comprising at least one slot in each of said finger-gripping arms and said slots each having a peripheral edge, there being at least two radially spaced slots in each of said finger-gripping arms.

* * * * *